US007123180B1

(12) United States Patent
Daniell et al.

(10) Patent No.: US 7,123,180 B1
(45) Date of Patent: Oct. 17, 2006

(54) SYSTEM AND METHOD FOR CONTROLLING AN ELECTRONIC DEVICE USING A SINGLE-AXIS GYROSCOPIC REMOTE CONTROL

(75) Inventors: Piers John Daniell, Fort Collins, CO (US); Jonathan Barton White, Fort Collins, CO (US)

(73) Assignee: NVIDIA Corporation, Santa Clara, CA (US)

( * ) Notice: Subject to any disclaimer, the term of this patent is extended or adjusted under 35 U.S.C. 154(b) by 454 days.

(21) Appl. No.: 10/630,007

(22) Filed: Jul. 29, 2003

(51) Int. Cl.
*G08C 19/12* (2006.01)

(52) U.S. Cl. ..... 341/176; 345/156; 348/352

(58) Field of Classification Search ..... 341/176; 340/825.69, 825.72; 348/734, 352; 359/142; 345/156, 158
See application file for complete search history.

(56) References Cited

U.S. PATENT DOCUMENTS 6,339,706 B1 * 1/2002 Tillgren et al. ..... 455/419
6,489,945 B1 * 12/2002 Gordon ..... 345/158
6,603,420 B1 * 8/2003 Lu ..... 341/176
6,750,801 B1 * 6/2004 Stefanik ..... 341/176
2002/0068556 A1 * 6/2002 Brown ..... 455/420
2003/0142065 A1 * 7/2003 Pahlavan ..... 345/156
2004/0203351 A1 * 10/2004 Shearer et al. ..... 455/41.1

* cited by examiner

*Primary Examiner*—Timothy Edwards, Jr.
(74) *Attorney, Agent, or Firm*—Patterson & Sheridan, L.L.P.

(57) ABSTRACT

A remote control device and method are described for controlling an input parameter to an electronic device. In one embodiment, the remote control device includes a housing sized to be held in the hand of a user during operation of the remote control device and a gyroscopic sensor that is integrated with the housing and configured to produce a signal in response to an angular motion about a single reference axis. The input parameter that the user wants to control is responsive to the signal that the gyroscopic sensor produces when the gyroscopic sensor is activated.

32 Claims, 5 Drawing Sheets

SYSTEM AND METHOD FOR CONTROLLING AN ELECTRONIC DEVICE USING A SINGLE-AXIS GYROSCOPIC REMOTE CONTROL

BACKGROUND OF THE INVENTION

1. Field of the Invention

This invention relates generally to remote control devices and more specifically to a system and method for controlling an electronic device with a single-axis gyroscopic remote control.

2. Description of the Background Art

Remote control devices are common in today's society thanks in large part to the proliferation of home electronic devices over the past several years. A typical remote control device has various input buttons that a user presses or holds down to control the different input parameters of the electronic device(s) that the remote control device is designed to control. For example, to control the volume of a television, the user normally points the remote control device towards the television and presses the volume up or the volume down button to adjust the volume. If the user wants to make more than a slight adjustment to the volume, the user normally either has to press the appropriate volume button several times or has to press and hold down the appropriate volume button until the desired volume level is attained.

One drawback of this type of remote control device is that having to press an input button several times to adjust an input parameter is cumbersome and time consuming. Also, having to hold down an input button and wait for the input parameter to adjust is oftentimes time consuming as well.

Another type of remote control device is a dual-axis gyroscopic remote control. Such a remote control device operates similarly to a computer "mouse" device in that the remote control device includes a dual-axis gyroscope that enables a user to manipulate the position of a cursor on the display screen of the electronic device being controlled. More specifically, the dual-axis gyroscope allows the user to control the position of the cursor in two dimensions, typically the horizontal and vertical directions relative to the face of the display screen, by pointing the remote control device at the display screen and moving his or her wrist. One type of wrist motion moves the cursor in the horizontal direction, and second type of wrist motion moves the cursor in the vertical direction. To control an input parameter with this type of remote control device, a user normally first points the cursor at an icon on the display screen that is configured to adjust the input parameter in the desired fashion when activated and then presses an input button on the remote control device to activate the icon (commonly referred to as "clicking on" the icon). For example, if the user wants to increase the volume of a television, the user first uses the remote control device to point the cursor at the "volume up" icon and then presses the input button on the remote control device to click on that icon. The dual-axis gyroscopic remote control and the television are configured such that clicking on the "volume up" icon increases the volume of the television. As with more traditional remote control devices, if the user wants to make more than a slight adjustment to the volume, the user normally either has to click on the "volume up" icon several times or has to press and hold down the input button on the dual-axis gyroscopic remote control while maintaining the cursor on the "volume up" icon until the desired volume level is attained.

One drawback of the dual-axis remote control device is that positioning the cursor on the display screen is difficult.

A common problem that users experience is known as "drift," where the cursor drifts in one dimension as the user tries to control the position of the cursor in the other dimension. Simultaneously controlling both degrees of freedom of the cursor requires a high degree of dexterity and much patience.

Another drawback of the dual-axis remote control device is that the cursor may move off of the icon that the user is trying to click on when the user presses the input button on the remote control device to activate that icon. If the cursor moves off the icon, then the icon may not activate properly. The consequence is that the user must reposition the cursor to point at the icon and then try clicking on that icon again.

Other drawbacks include those cited above for more traditional remote control devices. Namely, having to click on an icon several times to adjust an input parameter is cumbersome and time consuming. Also, having to hold down an input button while maintaining the cursor on the relevant icon until the input parameter adjusts as desired is cumbersome and time consuming as well.

SUMMARY OF THE INVENTION

One embodiment of a remote control device for controlling an input parameter of an electronic device includes a housing that is sized to be held in the hand of a user while operating the remote control device and a gyroscopic sensor that is integrated with the housing and configured to produce a signal in response to an angular motion about a single reference axis. The remote control device and the electronic device are configured such that the input parameter that the user wants to control responds to the signal that the gyroscopic sensor produces when the gyroscopic sensor is activated.

One advantage of the disclosed remote control device is that the gyroscopic sensor enables the user to adjust the input parameter by controlling only one degree of freedom of the remote control device. In addition, the design of the disclosed remote control device is similar to that of a traditional remote control and therefore is familiar to the user. The disclosed remote control device therefore allows the user to make quick, finely-tuned adjustments to the input parameter without having to press an input button continuously, point a cursor at an icon or control two degrees of freedom simultaneously.

DETAILED DESCRIPTION OF THE INVENTION

Figure 1:
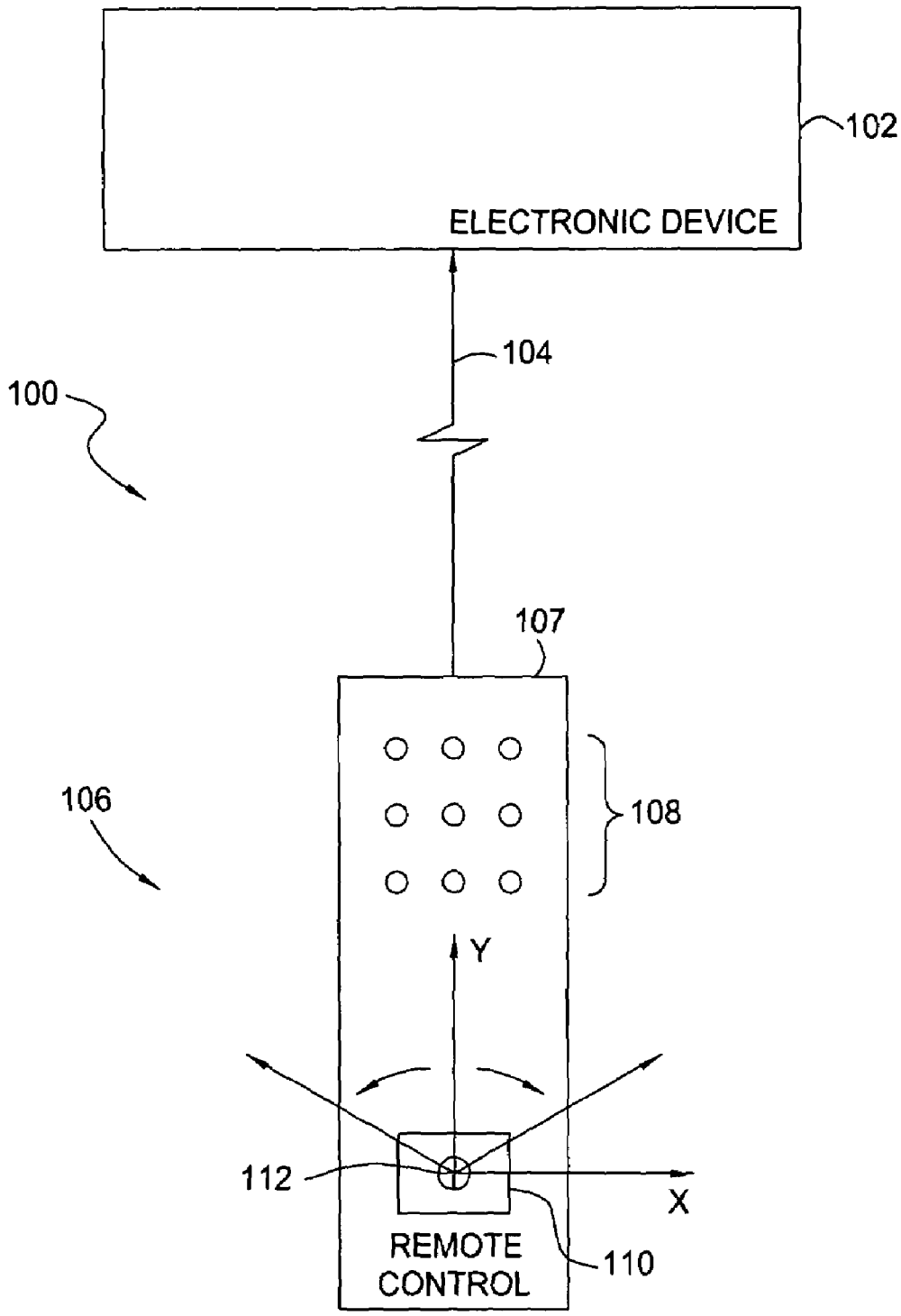
FIG. 1 is a top plan view illustrating one embodiment of a system for controlling an electronic device using a single-axis gyroscopic remote control, according to the invention.

FIG. 1 is a top plan view illustrating one embodiment of a system 100 for controlling an electronic device 102 using a single-axis gyroscopic remote control 106, according to the invention. As shown, system 100 may include, without limitation, electronic device 102 and single-axis gyroscopic remote control 106, which controls electronic device 102 using a control signal 104.

Electronic device 102 may be any type of electronic device capable of being controlled by control signal 104. For example, electronic device 102 may be, without limitation, a television, computer, DVD player, stereo receiver, CD player, any type of home entertainment system component or any type of electronic display device.

Single-axis gyroscopic remote control 106 is a standard remote control device modified to allow a user to control various input parameters or functionalities (hereinafter referred to as "input parameters") of electronic device 102 with simple wrist movements. As shown, single-axis gyroscopic remote control 106 may include, without limitation, a housing 107, input devices 108 and a gyroscopic sensor 110. Housing 107 is a standard remote control housing and may be made of any type of suitable material such as plastic, metal or hard rubber and is sized such that a user can comfortably hold single-axis gyroscopic remote control 106 during operation.

Input devices 108 allow the user to input various types of information into single-axis gyroscopic remote control 106 by pressing any one of or combination of input devices 108. In particular, the user may select an input parameter of electronic device 102 to control by pressing the one of input devices 108 corresponding to that particular input parameter. Input devices 108 may include, without limitation, any types of standard remote control analog or digital input devices.

Gyroscopic sensor 110 is the element of single-axis gyroscopic remote control 106 that allows the user to control the setting of a selected input parameter with simple wrist movements. More specifically, the user adjusts the setting of the selected input parameter by pointing single-axis gyroscopic remote control 106 towards electronic device 102 and moving his or her wrist to cause gyroscopic sensor 110 to rotate about a reference axis 112. As shown, gyroscopic sensor 110 is a z-axis gyroscopic sensor configured to output a signal derived from the angular motion about the z-axis (i.e., reference axis 112). As described in further detail herein, electronic device 102 and single-axis gyroscopic remote control 106 are configured such that the setting of the selected input parameter adjusts in response to the signal output by gyroscopic sensor 110. Two z-axis gyroscopic sensors that are well known in the art are the ADXRS300 and the ADXRS 150, both produced by Analog Devices. Other similar products include the SiRRS01 and the VSG, both produced by BAE Systems, and the Integrated Micro Devices gyroscope device.

As persons skilled in the art will recognize, motion about the z-axis is commonly referred to as the yaw motion. In other embodiments, gyroscopic sensor 110 may be configured such that reference axis 112 is either the x-axis or the y-axis. Where reference axis 112 is the x-axis, the user controls a selected input parameter by holding single-axis gyroscopic remote control 106 in his or her and simply moving his or her wrist such that gyroscopic sensor 110 rotates about the x-axis. Motion about the x-axis is commonly referred to as the pitch motion. Similarly, where reference axis 112 is the y-axis, the user controls a selected input parameter by holding single-axis gyroscopic remote control 106 in his or her hand and moving his or her wrist such that gyroscopic sensor 110 rotates about the y-axis. Motion about the y-axis is commonly referred to as the roll motion.

Gyroscopic sensor 110 is coupled to housing 107 such that rotating single-axis gyroscopic remote 106 about reference axis 112 imparts a rotational force on housing 107, which in turn imparts a rotational force on gyroscopic sensor 110. The rotational force exerted on gyroscopic sensor 110 causing gyroscopic sensor 110 to rotate about reference axis 112. In one embodiment, gyroscopic sensor 110 is disposed within housing 107 such that gyroscopic sensor 110 is an internal component of single-axis gyroscopic remote control 106. In alternative embodiments, gyroscopic sensor 110 may be disposed partially within housing 107 or outside of housing 107 such that gyroscopic sensor 110 is an external component of single-axis gyroscopic remote control 106.

Control signal 104 may be any type of modulated carrier wave signal suitable for transmitting information to electronic device 102. As shown, control signal 104 is an infrared signal. In alternative embodiments, control signal 104 may be a radio frequency or other similar signal.

Figure 2:
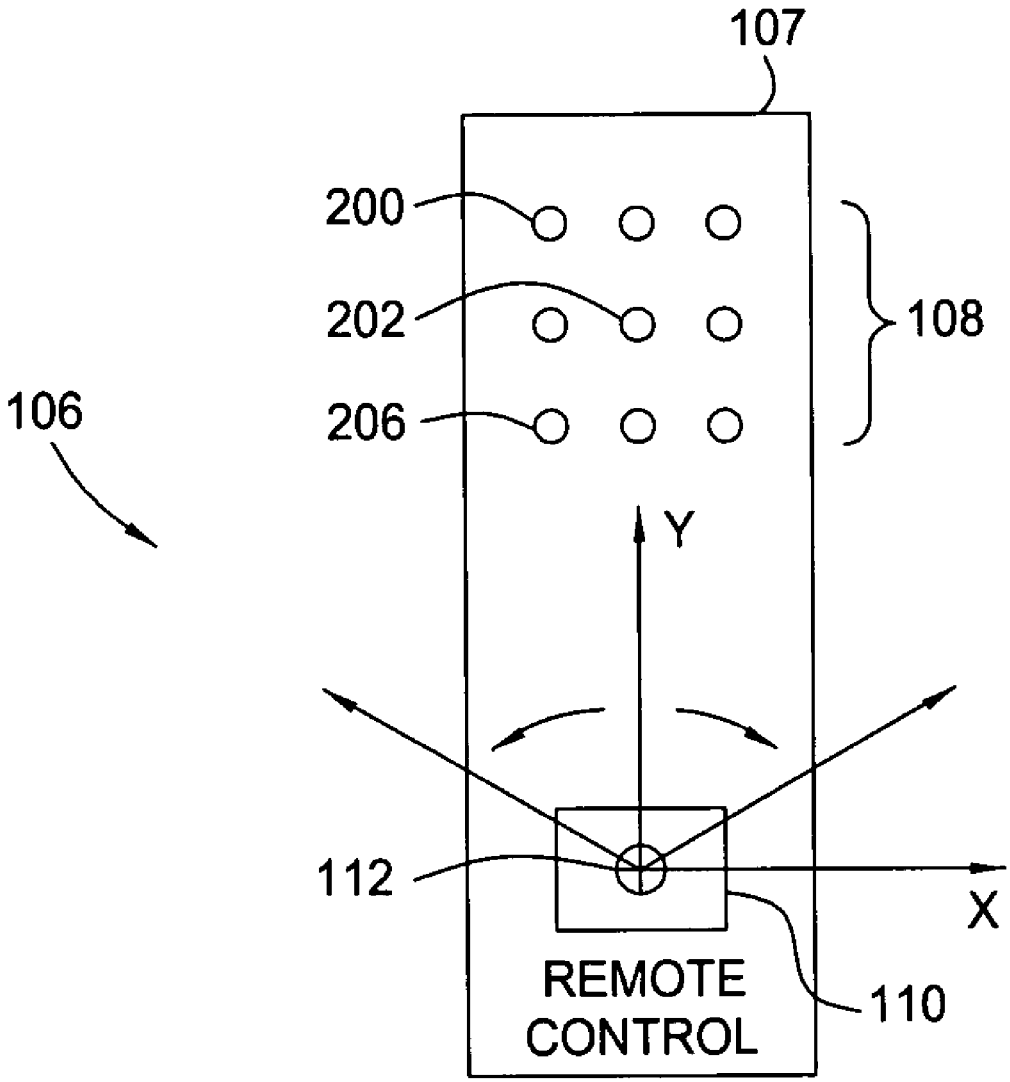
FIG. 2 is a top plan view illustrating one embodiment of the single-axis gyroscopic remote control of FIG. 1, according to the invention.

FIG. 2 is a top plan view illustrating one embodiment of single-axis gyroscopic remote control 106 of FIG. 1, according to the invention. As shown, single-axis gyroscopic remote control 106 may include, without limitation, input devices 108, which are configured to enable the user to select the various input parameters of electronic device 102 that he or she wants to control, an activation input 206, which is a specific one of input devices 108 that is configured to activate gyroscopic sensor 110, and gyroscopic sensor 110, which is configured to control the setting of the selected input parameter through the motion of the user's wrist.

In one embodiment, and as described in more detail below in conjunction with FIG. 3, to adjust a particular input parameter of electronic device 102, the user presses the one of input devices 108 corresponding to that input parameter. Single-axis gyroscopic remote control 106 is configured to transmit control signal 104 to electronic device 102 in response to the user's selection that communicates the identity of the selected input parameter and the fact that the user wants to change the current setting of that input parameter. The user then presses and holds down activation input 206. Single-axis gyroscopic remote control 106 is configured to begin processing the output signal of gyroscopic sensor 110, thereby activating gyroscopic sensor 110, in response to the user's pressing and holding down activation input 206. While holding down activation input 206 and pointing single-axis gyroscopic remote control 106 towards electronic device 102, the user moves his or her wrist such that gyroscopic sensor 110 rotates about reference axis 112. In response to the user's wrist movements, gyroscopic sensor 110 outputs a signal derived from the angular motion of gyroscopic sensor 110 about reference axis 112. Single-axis gyroscopic remote control 106 is configured to transmit control signal 104 to electronic device 102 in response to the output signal of gyroscopic sensor 110. Control signal 104 causes electronic device 102 to change the selected input parameter. When the selected input parameter arrives at the setting that the user desires, the user releases activation input 206. Single-axis gyroscopic remote control 106 is configured to stop processing the output signal of gyroscopic sensor 110 in response to the user's releasing activation input 206, thereby ending the user's control of the selected input parameter.

As persons skilled in the art will recognize, single-axis gyroscopic remote control 106 may be designed to operate in a more interactive fashion with electronic device 102. For example, in an alternative embodiment, input devices 108 may include navigation buttons that allow the user to select input parameters using an audio or video menu (or any type of graphical user interface) managed by electronic device 102. Once the user has selected the input parameter that he or she wants to control using the audio or video menu, the user then uses activation button 206 and gyroscopic sensor 110 to adjust the setting of the selected input parameter as described herein. In other embodiments, single-axis gyroscopic remote control 106 and electronic device 102 may be configured to allow the user to select the input parameter that he or she wants to control in any variety of ways without limiting the scope of the invention.

In one embodiment, electronic device 102 and single-axis gyroscopic remote control 106 are configured such that a given amount of rotation about reference axis 112 in the clockwise direction by gyroscopic sensor 110 results in a corresponding amount of change in the setting of the selected input parameter in a particular direction (e.g., a given amount of clockwise rotation results in a given increase in volume or a certain amount of fast forward scan). Similarly, a given amount of rotation about reference axis 112 in the counterclockwise direction by gyroscopic sensor 110 results in a corresponding amount of change in the setting of the selected input parameter in the opposite direction (e.g., a given amount of counterclockwise rotation results in a given decrease in volume or a certain amount of reverse scan). In another embodiment, electronic device 102 and single-axis gyroscopic remote control 106 also are configured such that a greater angular velocity about reference axis 112 in the clockwise direction by gyroscopic sensor 110 results in a greater corresponding rate of change in the setting of the selected input parameter in a particular direction (e.g., a faster clockwise rotation results in a faster volume increase or a faster fast forward scan). Similarly, a greater angular velocity about reference axis 112 in the counterclockwise direction by gyroscopic sensor 110 results in a greater corresponding rate of change in the setting of the selected input parameter in the opposite direction (e.g., a faster counterclockwise rotation results in a faster the volume decreases or a faster reverse scan).

As persons skilled in the art will recognize, in other embodiments, electronic device 102 and single-axis gyroscopic remote control 106 may be configured such that changes in the selected input parameter correspond to other parameters of the angular motion of gyroscopic sensor 110 about reference axis 112. For example, in an alternative embodiment, changes in the setting of the selected input parameter may correspond directly to angular velocity of gyroscopic sensor 110 about reference axis 112 or the angular momentum about reference axis 112. In yet another embodiment, the rate of change of the setting of the selected input parameter may correspond directly to the angular acceleration of gyroscopic sensor 110 about reference axis 112 or the rate of change of the angular momentum about reference axis 112.

The following are examples of how the user may use single-axis gyroscopic remote control 106 to control various input parameters of electronic device 102, according to one embodiment of the invention. In a first example, electronic device 102 is a television, and an input device 200 is the specific one of input devices 108 used to control the volume of the television. To adjust the volume, the user first presses input device 200. This action causes single-axis gyroscopic remote control 106 to transmit control signal 104 to the television that communicates that the user wants to change the current volume level of the television. The user then presses and holds down activation input 206. This action causes single-axis gyroscopic remote control 106 to activate gyroscopic sensor 110. While holding down activation input 206, the user points single-axis gyroscopic remote control 106 towards the television and moves his or her wrist such that gyroscopic sensor 110 rotates about reference axis 112. This action causes gyroscopic sensor 110 to output a signal derived from the angular motion of gyroscopic sensor 110 about reference axis 112. Single-axis gyroscopic remote control 106 is configured to transmit control signal 104 to the television in response to the output signal of gyroscopic sensor 110. Control signal 104 causes the volume level of the television to change. In one embodiment, rotating gyroscopic sensor 110 about reference axis 112 in a clockwise direction to produce a large yaw angle causes a large increase in the volume of the television. Similarly, rotating gyroscopic sensor 110 about reference axis 112 in a counterclockwise direction to produce a small yaw angle causes a small decrease in the volume of the television. In another embodiment, an additional feature is that a greater angular velocity of gyroscopic sensor 110 about reference axis 112 in a clockwise direction causes a faster increase in the volume of the television. Similarly, a slower angular velocity of gyroscopic sensor 110 about reference axis 112 in a counterclockwise direction causes a slower decrease in the volume of television. Finally, when the volume is at the desired level, the user releases activation input 206.

In a second example, electronic device 102 is a DVD player coupled to a display device, and an input device 202 is the specific one of input devices 108 used to control the time search functionality of the DVD player. To find a specific part of a DVD program that the user wants to watch, the user first presses input device 202. This action causes single-axis gyroscopic remote control 106 to transmit control signal 104 to the DVD player that indicates that the user wants to use the time search functionality to find a specific part of the DVD program that the user currently is watching. The user then presses and holds down activation input 206. This action causes single-axis gyroscopic remote control 106 to activate gyroscopic sensor 110. While holding down activation input 206, the user points single-axis gyroscopic remote control 106 towards the DVD player and moves his or her wrist such that gyroscopic sensor 110 rotates about reference axis 112. This action causes gyroscopic sensor 110 to output a signal derived from the angular motion of gyroscopic sensor 110 about reference axis 112. Single-axis gyroscopic remote control 106 is configured to transmit control signal 104 to the DVD player in response to the output signal of gyroscopic sensor 110. Control signal 104 causes the value of the time code of the DVD program to change (note that each time code value corresponds to a particular part of a DVD program). In one embodiment, rotating gyroscopic sensor 110 about reference axis 112 in a clockwise direction to produce a large yaw angle causes a large increase in the value of the time code. Similarly, rotating gyroscopic sensor 110 about reference axis 112 in a counterclockwise direction to produce a small yaw angle causes a small decrease in the value of the time code. Again, in another embodiment, an additional feature is that a greater angular velocity of gyroscopic sensor 110 about reference axis 112 in a clockwise direction causes a faster increase in the value of the time code. Similarly, a slower angular velocity of gyroscopic sensor 110 about reference axis 112 in a counterclockwise direction causes a slower decrease in the value of the time code. Finally, when the time code corresponds to the part of the DVD program that the user wants to watch, the user releases activation input 206.

In other embodiments, single-axis gyroscopic remote control 106 may be configured to control the setting of any input parameter of electronic device 102 capable of being controlled using gyroscopic sensor 110. For example, input parameters also may include, without limitation, the tint, color, brightness and contrast parameters of a display device, the channel tuning functionality of a television, stereo receiver or other similar electronic device and the scanning functionality of a DVD or CD player or other similar electronic device.

Figure 3:
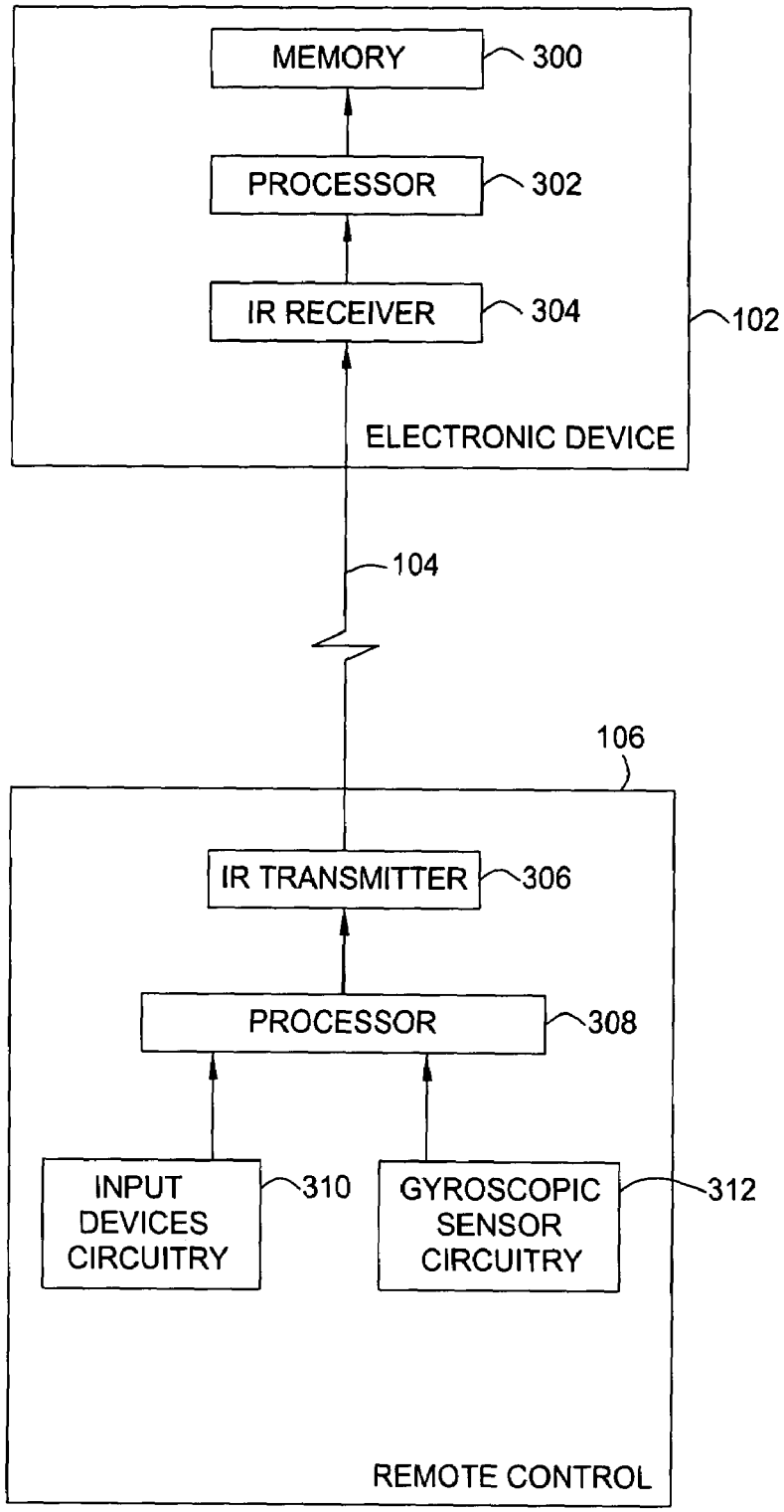
FIG. 3 is a functional block diagram illustrating one embodiment of the electronic device and the single-axis gyroscopic remote control of FIG. 1, according to the invention.

FIG. 3 is a functional block diagram illustrating one embodiment of electronic device 102 and single-axis gyroscopic remote control 106 of FIG. 1, according to the invention. As shown, electronic device 102 may include, without limitation, a memory 300 coupled to a processor 302, which is coupled to an IR receiver 304. As also shown, single-axis gyroscopic remote control 106 may include, without limitation, an IR transmitter 306 coupled to a processor 308, which is coupled to input devices circuitry 310 and gyroscopic sensor circuitry 312. Those skilled in the art will recognize these general configurations of electronic device 102 and single-axis gyroscopic remote control 106 and will understand that both electronic device 102 and single-axis gyroscopic remote control 106 may be configured in many other ways.

As described herein, in one embodiment, the user selects the particular input parameter of electronic device 102 that he or she wants to control by pressing the one of input devices 108 that corresponds to that input parameter. In addition, the user presses and holds down activation input 206 to activate gyroscopic sensor 110 and releases activation input 206 to deactivate gyroscopic sensor 110 when he or she finishes adjusting the selected input parameter. Input devices circuitry 310 may include one or more sensors and is configured to detect which one of input devices 108 the user presses and to transmit that information to processor 308. Input devices circuitry 310 is further configured to detect when the user presses and holds down activation input 206 and when the user releases activation input 206. Input device circuitry 310 also is configured to transmit that information to processor 308.

As also described herein, while pressing a holding down activation input 206, the user moves his or her wrist to rotate gyroscopic sensor 110 about reference axis 112 to adjust the setting of the selected input parameter. Gyroscopic sensor circuitry 312 is configured to enable gyroscopic sensor 110 to output a signal derived from the angular motion of gyroscopic sensor 110 about reference axis 112. Gyroscopic sensor circuitry is further configured to transmit that signal to processor 308.

Processor 308, among other things, is configured to receive both the information transmitted by input devices circuitry 310 and the signal transmitted by gyroscopic sensor circuitry 312, to process the received information and signal and to perform certain operations based on the received information and signal. More specifically, in response to receiving information about which input device 108 the user presses, processor 308 is configured to determine which input parameter the user wants to control and to transmit that information to IR transmitter 306. Processor 308 is further configured to signal IR transmitter 306 to generate and to transmit control signal 104 to electronic device 102 that communicates the identity of the selected input parameter.

In response to receiving information that the user presses and holds down activation input 206, processor 308 is configured to begin processing the signal transmitted by gyroscopic sensor circuitry 312. In one embodiment, processor 308 is configured to determine from the signal received from gyroscopic sensor circuitry 312 the amount of rotation by gyroscopic sensor 110 about reference axis 112 and the direction of the rotation as well as the angular velocity of gyroscopic sensor 110 about reference axis 112 and the direction of the angular velocity. Processor 308 is further configured to determine from this information the specific adjustments that the user wants to make to the setting of the selected input parameter. In addition, processor 308 is configured to signal IR transmitter 306 to generate and to transmit control signal 104 to electronic device 102 that communicates the specific adjustments that the user wants to make to the setting of the selected input parameter.

Lastly, in response to receiving information that the user releases activation input 206, processor 308 is configured to stop processing information transmitted by gyroscopic sensor circuitry 312 and to signal IR transmitter 306 to stop transmitting command signals 104 to electronic device 102.

IR transmitter 306 is configured to receive the information about the identity of the selected input parameter and the adjustments that the user wants to make to the selected input parameter transmitted by processor 308. IR transmitter 306 is further configured to generate and to transmit control signals 104 (in response to signals received from processor 308) that communicate this information to electronic device 102. IR transmitter 306 typically modulates a carrier wave using any type of appropriate modulation technique and the information received from processor 308 to generate control signals 104.

IR receiver 304 is configured to receive control signals 104 transmitted by IR transmitter 306 and to demodulate those signals using the inverse of the modulation technique implemented by IR transmitter 306. IR receiver 304 is further configured to transmit the demodulated signals to processor 302 for further processing.

Processor 302, among other things, is configured to receive the demodulated signals transmitted by IR receiver 304 and to determine from those signals the identity of the selected input parameter and the adjustments that the user wants to make to the selected input parameter. Processor 302 is further configured to transmit this information to memory 300.

Memory 300 is configured to receive the information transmitted by processor 302 and to execute the operations necessary to adjust the selected input as specified by the user. Memory 300 may contain, without limitation, the operational software of electronic device 102 as well as random access memory (RAM). In addition, a portion of memory 300 may be read-only memory (ROM).

As persons skilled in the art will recognize, processor 308 and processor 302 may be configured such that processor 308 performs a very limited amount of processing on the signal received from gyroscopic sensor circuitry 312. For example, in an alternative embodiment, processor 308 may be configured to control IR transmitter 306 such that IR transmitter 306, among other things, generates and transmits modulated control signal 104 to electronic device 102 that contains the data transmitted by gyroscopic sensor circuitry 312. Processor 302, in turn, may be configured to receive the demodulated control signal from IR receiver 304. Processor 302 also may be configured to determine from that signal the amount of rotation by gyroscopic sensor 110 about reference axis 112 and the direction of the rotation as well as the angular velocity of gyroscopic sensor 110 about reference axis 112 and the direction of the angular velocity. Processor 302 may be further configured to determine from this position and velocity information the specific adjustments that the user wants to make to the setting of the selected input parameter and to transmit that adjustment information to memory 300. In other embodiments, processor 308 and processor 302 may be configured to perform any amounts of processing on the signal transmitted by gyroscopic sensor circuitry 312 or on the signals transmitted by any other elements of single-axis gyroscopic remote control 106. In yet other embodiments, processor 308 may be eliminated, and processor 302 may be configured to perform all processing functionalities. The configuration of the processor(s) that reside in single-axis gyroscopic remote control 106 and electronic device 102, respectively, or as the case may be, does not limit the scope of the invention.

Figure 4A:
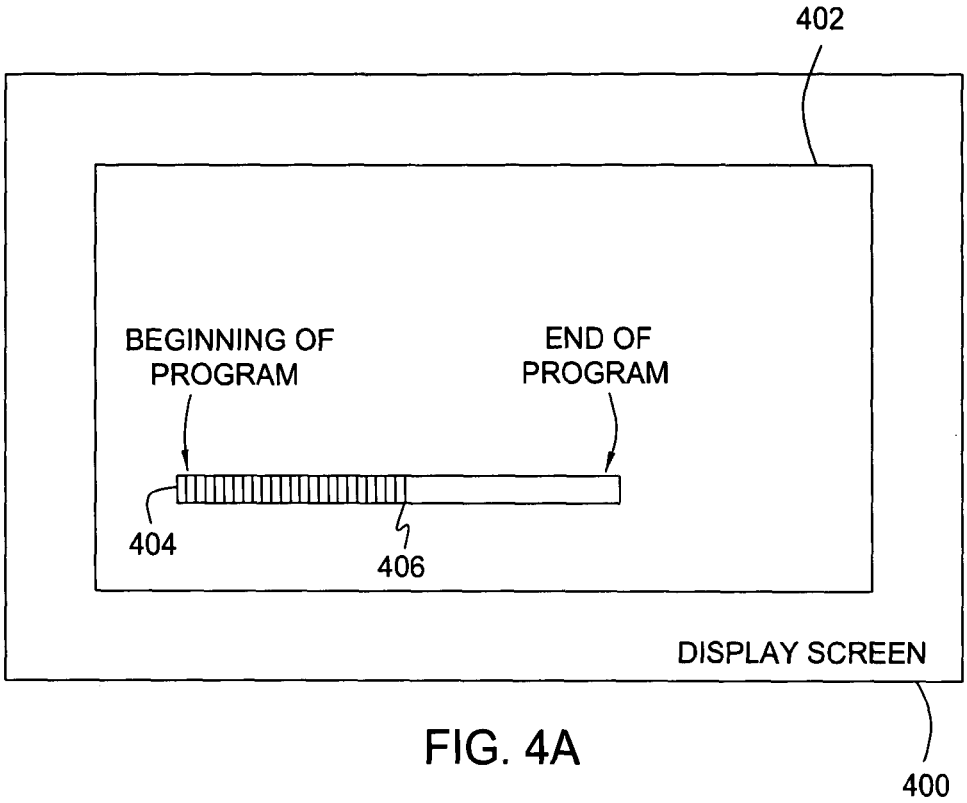
FIG. 4A illustrates one embodiment of a graphical user interface with a slider scale for controlling a scan of a DVD program, according to the invention.

FIG. 4A illustrates one embodiment of a graphical user interface 402 with a slider scale 404 for controlling a scan of a DVD program, according to the invention. As shown, a display screen 400 includes, without limitation, graphical user interface 402, which includes, also without limitation, slider scale 404. The left portion of slider scale 404 indicates the beginning of the DVD program, and the right portion of slider scale 404 indicates the end of the DVD program. An indicator bar 406 is configured to move back and forth between the left and right portions of slider scale 404 to display graphically to the user where the scan functionality of a DVD player currently is tracking the DVD program relative to the beginning and end of the DVD program.

As described herein, the user selects "scan" as the input parameter that the user wants to control by pressing the one of input devices 108 corresponding to the scan functionality. The user also presses and holds down activation input 206. The user controls where the scan functionality tracks the DVD program by then pointing single-axis gyroscopic remote control 106 towards electronic device 102 (here, a DVD player coupled to display screen 400) and moving his or her wrist such that gyroscopic sensor 110 rotates about reference axis 112. In one embodiment, a clockwise rotation of gyroscopic sensor 110 causes the scan functionality to track forward, towards the end of the DVD program, and indicator bar 406 is configured to move towards the right portion of slider scale 404 in response. Similarly, a counterclockwise rotation causes the scan functionality to track backwards, towards the beginning of the DVD program, and indicator bar 406 is configured to move towards the left portion of slider scale 404 in response. The user releases activation input 206 when indicator bar 406 is at a position that corresponds with the part of the DVD program that the user wants to watch.

In other embodiments, slider scale 404 may be used to display graphically to the user the setting of other selected input parameters of electronic device 102. For example, other such selected input parameters may include, without limitation, the volume, tint, color, brightness and contrast parameters of a television or other display device and the scan functionality of a CD player or other similar electronic device.

Figure 4B:
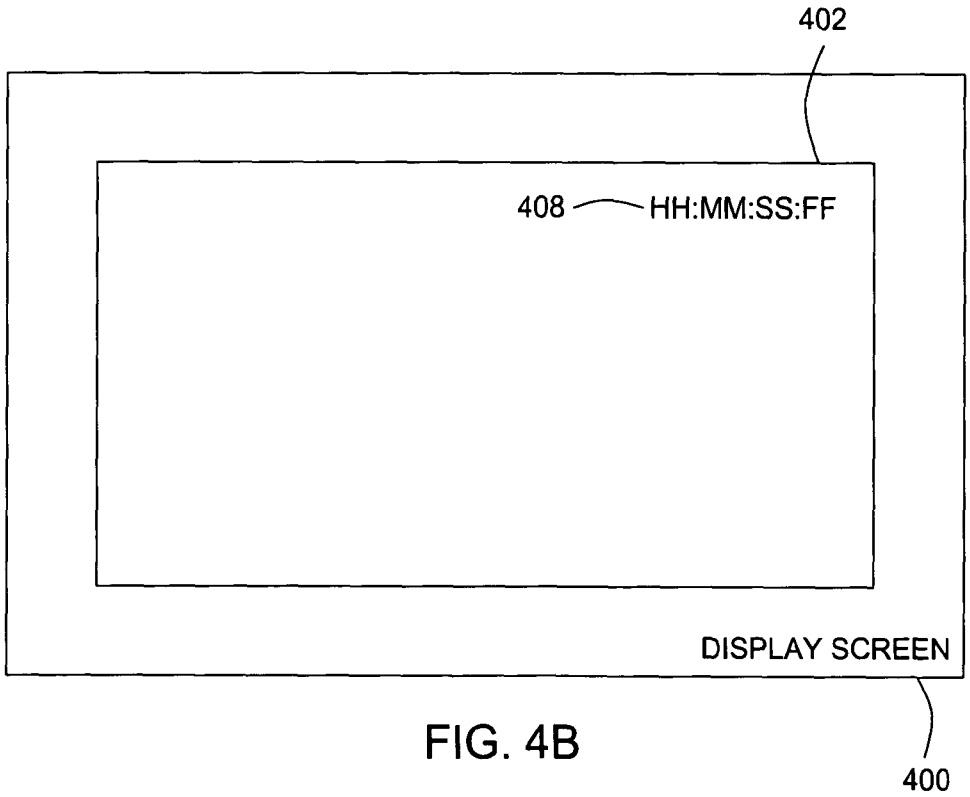
FIG. 4B illustrates an alternative embodiment of the graphical user interface of FIG. 4A with an SMPTE code for controlling a time search of a DVD program, according to the invention.

FIG. 4B illustrates an alternative embodiment of graphical user interface 402 of FIG. 4A with an SMPTE code 408 for controlling a time search of a DVD program, according to the invention. As shown, display screen 400 includes, without limitation, graphical user interface 402, which includes, also without limitation, SMPTE code 408. Typically, SMPTE code 408 is configured to display graphically to the user the exact location of where the tracking functionality of a DVD player currently is tracking the DVD program.

As described herein, the user selects "time search" as the input parameter that the user wants to control by pressing the one of input devices 108 corresponding to the time search functionality. The user also presses and holds down activation input 206. The user controls where the tracking functionality tracks the DVD program by pointing single-axis gyroscopic remote control 106 towards electronic device 102 (again, a DVD player coupled to display screen 400) and moving his or her wrist such that gyroscopic sensor 110 rotates about reference axis 112. In one embodiment, a clockwise rotation causes the tracking functionality to track forward, in a direction towards the end of the DVD program, and SMPTE code 408 is configured to increase in value in response. Similarly, a counterclockwise rotation causes the tracking functionality to track backwards, in a direction towards the beginning of the DVD program, and SMPTE code 408 is configured to decrease in value in response. The user releases activation input 206 when SMPTE code 408 has a value that corresponds with the part of the DVD program that the user wants to watch.

Figure 5:
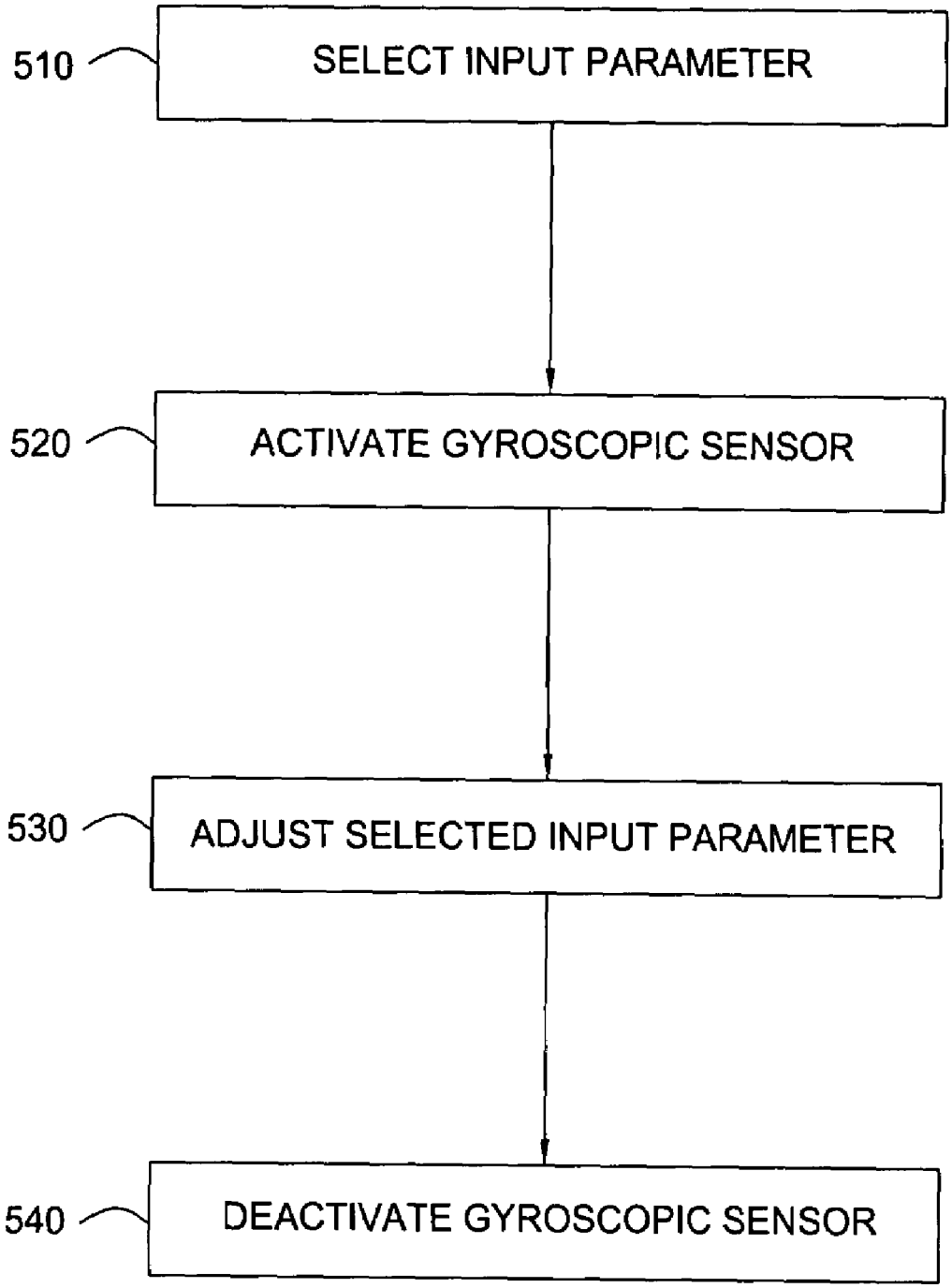
FIG. 5 shows a flowchart of method steps for controlling an electronic device using a single-axis gyroscopic remote control, according to one embodiment of the invention.

FIG. 5 shows a flowchart of method steps for controlling electronic device 102 using single-axis gyroscopic remote control 106, according to one embodiment of the invention. Although the method steps are described in the context of the systems illustrated in FIGS. 1–4, any system configured to perform the method steps is within the scope of the invention.

As shown in FIG. 5, the method of controlling electronic device 102 starts in step 510 where the user selects the input parameter of electronic device 102 that he or she wants to control. As described herein, in one embodiment, the user presses the one of input devices 108 on single-axis gyroscopic remote control 106 that corresponds to the input parameter that the user wants to adjust. In step 520, the user activates gyroscopic sensor 520. In one embodiment, the user presses and holds down activation input 206 on single-axis gyroscopic remote control 106 to accomplish this task.

In step 530, the user adjusts the selected input parameter. As described herein, in one embodiment, the user points single-axis gyroscopic remote control towards electronic device 102 and moves his or her wrist such that gyroscopic sensor 110 rotates about reference axis 112, the yaw axis. Electronic device 102 and single-axis gyroscopic remote control 106 are configured such that the rotational motion of gyroscopic sensor 110 about reference axis 112 causes the setting of the selected input parameter to change. For example, in one embodiment, a given amount of rotation about reference axis 112 in either a clockwise or counterclockwise direction results in corresponding amount of change to the setting of the selected input parameter. In another embodiment, an additional feature is that a greater angular velocity about reference axis 112 in either a clockwise or counterclockwise direction results in a faster corresponding change in the setting of the selected input parameter.

In step 540, the user deactivates gyroscopic sensor 110, thereby effectively ending the user's control of the selected input parameter. In one embodiment, the user releases activation input 206 to accomplish this task.

One advantage of the device and method described above is that gyroscopic sensor 110 enables the user to adjust a selected input parameter by controlling only one degree of freedom of single-axis gyroscopic remote control 106. In addition, the design of single-axis gyroscopic remote control 106 is similar to that of a traditional remote control and therefore is familiar to the user. Single-axis gyroscopic remote control 106 therefore allows the user to make quick, finely-tuned adjustments to the selected input parameter without having to press an input button continuously, point a cursor at an icon or control two degrees of freedom simultaneously.

The invention has been described above with reference to specific embodiments. Persons skilled in the art, however, will understand that various modifications and changes may be made thereto without departing from the broader spirit and scope of the invention as set forth in the appended claims. For example, in an alternative embodiment, single-axis gyroscopic remote control 106 may be configured such that pressing a particular one of input devices 108 not only selects the particular input parameter that the user wants to control, but also activates gyroscopic sensor 110. In such an embodiment, single-axis gyroscopic remote control 106 does not have activation input 206. The user simply presses and holds down the applicable one of input devices 108 and then moves his or her wrist as described herein to adjust the setting of the selected input parameter. Processor 308 is configured to determine which input parameter the user wants to control and to begin processing information transmitted by gyroscopic sensor 110 in response to the user's pressing and holding down the applicable one of input devices 108. When the user is done adjusting the selected input parameter, he or she simply releases the applicable one of input devices 108. The foregoing description and drawings are, accordingly, to be regarded in an illustrative rather than a restrictive sense.

What is claimed is:

1. A remote control device for controlling an input parameter of an electronic device, the remote control device comprising:

a housing sized to be held in the hand of a user during operation of the remote control device;

a gyroscopic sensor integrated with the housing and configured to produce a signal in response to an angular motion about a single reference axis, the input parameter to be controlled being responsive to the signal produced by the gyroscopic sensor when the gyroscopic sensor is activated; and a transmitter configured to transmit a control signal to the electronic device, the control signal being produced in response to the signal produced by the gyroscopic sensor, wherein a portion of the control signal comprises an identity of the input parameter to be controlled.

2. The remote control device of claim 1, further comprising an input device integrated with the housing and configured such that the user presses the input device to select the input parameter to be controlled.

3. The remote control device of claim 1, further comprising an activation input integrated with the housing and configured such that the user presses and holds down the activation input to activate the gyroscopic sensor.

4. The remote control device of claim 1, further comprising an input device integrated with the housing and configured such that the user presses and holds down the input device to select the input parameter to be controlled and to activate the gyroscopic sensor.

5. The remote control device of claim 1, wherein the single reference axis is a yaw axis.

6. The remote control device of claim 1, wherein the single reference axis is a pitch axis.

7. The remote control device of claim 1, wherein the single reference axis is a roll axis.

8. The remote control device of claim 1, wherein the input parameter to be controlled is volume.

9. The remote control device of claim 1, wherein the input parameter to be controlled is a scan functionality.

10. The remote control device of claim 1, wherein the input parameter to be controlled is a time search functionality.

11. The remote control device of claim 1, wherein the control signal is an infrared signal.

12. The remote control device of claim 1, wherein the control signal is a radio frequency signal.

13. A method for controlling an electronic device using a remote control device, the method comprising:

selecting an input parameter to be controlled;

activating a gyroscopic sensor, the gyroscopic sensor being integrated with a housing of the remote control device and configured to produce a signal in response to an angular motion about a single reference axis, the input parameter to be controlled being responsive to the signal produced by the gyroscopic sensor when the gyroscopic sensor is activated;

transmitting a control signal, the control signal being produced in response to the signal produced by the gyroscopic sensor, wherein a portion of the control signal comprises an identity of the input parameter to be controlled; and adjusting a setting of the input parameter to be controlled.

14. The method of claim 13, further comprising the step of deactivating the gyroscopic sensor.

15. The method of claim 14, wherein deactivating the gyroscopic sensor comprises releasing an input device.

16. The method of claim 14, wherein deactivating the gyroscopic sensor comprises releasing an activation input.

17. The method of claim 13, wherein selecting an input parameter comprises pressing at least one input device that corresponds to the input parameter to be controlled.

18. The method of claim 13, wherein selecting an input parameter comprises pressing at least one input device to identify the input parameter on a graphical user interface.

19. The method of claim 13, wherein selecting an input parameter comprises enunciating a voice command to identify the input parameter on an audio menu.

20. The method of claim 13, wherein selecting an input parameter comprises pressing at least one input device until the electronic device enunciates the input parameter.

21. The method of claim 13, wherein activating a gyroscopic sensor comprises pressing and holding down an activation input.

22. The method of claim 13, wherein selecting an input parameter and activating a gyroscopic sensor comprises pressing and holding down an input device that corresponds to the input parameter to be controlled.

23. The method of claim 13, wherein adjusting a setting of the input parameter comprises moving the remote control device when the gyroscopic sensor is activated such that the gyroscopic sensor produces the signal.

24. A remote control device for controlling an input parameter of an electronic device, the remote control device comprising:

means for selecting the input parameter to be controlled;

means for activating a gyroscopic sensor, the gyroscopic sensor being integrated with a housing of the remote control device and configured to produce a signal in response to an angular motion about a single reference axis, the input parameter to be controlled being responsive to the signal produced by the gyroscopic sensor when the gyroscopic sensor is activated;

means for transmitting a control signal, the control signal being produced in response to the signal produced by the gyroscopic sensor, wherein a portion of the control signal comprises an identity of the input parameter to be controlled; and means for adjusting a setting of the input parameter to be controlled.

25. The remote control device of claim 24, further comprising means for deactivating the gyroscopic sensor.

26. The system of claim 24, wherein means for adjusting a setting of the input parameter comprises means for moving the remote control device when the gyroscopic sensor is activated such that the gyroscopic sensor produces the signal.

27. A system for controlling an input parameter to an electronic device, the system comprising:

a remote control device, including a housing sized to be held in the hand of a user during operation of the remote control device; and a gyroscopic sensor integrated with the housing and configured to produce a signal in response to an angular motion about a single reference axis, the input parameter to be controlled being responsive to the signal produced by the gyroscopic sensor when the gyroscopic sensor is activated;

a transmitter configured to transmit a control signal to the electronic device, the control signal being produced in response to the signal produced by the gyroscopic sensor, wherein a portion of the control signal comprises an identity of the input parameter to be controlled; and a display screen coupled to the electronic device and including a graphical user interface configured to display graphically to the user a setting of the input parameter to be controlled.

28. The system of claim 27, wherein the graphical user interface includes a slider scale configured to display graphically to the user the setting of the input parameter to be controlled.

29. The system of claim 28, wherein the input parameter to be controlled is volume.

30. The system of claim 28, wherein the input parameter to be controlled is a scan functionality.

31. The system of claim 27, wherein the graphical user interface includes an SMPTE code configured to display graphically to the user the setting of the input parameter to be controlled.

32. The system of claim 31, wherein the input parameter to be controlled is a time search functionality.

* * * * *